US006144345A

United States Patent [19]

Kuether

[11] Patent Number: 6,144,345

[45] Date of Patent: Nov. 7, 2000

[54] VARIABLE ATTENUATOR FOR SATELLITE SIGNALS

[75] Inventor: David J. Kuether, Walnut, Calif.

[73] Assignee: Hughes Electronics Corporation, El Segundo, Calif.

[21] Appl. No.: 08/709,400

[22] Filed: Sep. 4, 1996

[51] Int. Cl.[7] ..... H01Q 19/10

[52] U.S. Cl. ..... 343/834; 343/703; 343/772; 343/909

[58] Field of Search ..... 343/909, 703, 343/840, 841, 772, 834; H01Q 17/00, 19/10

[56] References Cited

U.S. PATENT DOCUMENTS 4,888,596 12/1989 Conanan ..... 343/703
5,166,698 11/1992 Ashbaugh et al. ..... 343/783

FOREIGN PATENT DOCUMENTS 61-238108 10/1986 Japan ..... H01Q 17/00

*Primary Examiner*—Don Wong
*Assistant Examiner*—Shih-Chao Chen
*Attorney, Agent, or Firm*—John A. Crook; Michael W. Sales

[57] ABSTRACT

For use in or with a satellite receiving system having a receiving element such as low noise amplifier, a selectively variable RF signal attenuator locatable between the satellite and the amplifier comprises an RF radiation shield having at least one selectively variable radiation-passing area. The radiation shield comprises a plurality of overlapped shield members having selectively overlapped openings, movement of one member relative to the other causing the effective intersection defining a radiation-passing area of the shield to vary. According to a disclosed method, after locating a radiation attenuator as described between the satellite and the amplifier, the signal received from the satellite is variably attenuated using the signal attenuator until the signal level of the received radiation is within a range of an associated signal indicator wherein the indicator's response is more linear than it is at higher signal levels. The position of the collector is then adjusted until the indicator output peaks. Finally, the attenuation is reduced or eliminated to permit normal operation of the satellite receiving system.

26 Claims, 5 Drawing Sheets

VARIABLE ATTENUATOR FOR SATELLITE SIGNALS

BACKGROUND OF THE INVENTION

1. Field of the Invention

The invention relates to direct broadcast satellite systems, and particularly to improvements in aperture and method for collector alignment.

With the advent of consumer satellite receivers, particularly satellite receivers having inexpensive small aperture collectors intended for optional installation by the user, it is of paramount commercial importance that the collector (and associated elements) be capable of being quickly, easily, and inexpensively aligned with a satellite whose transmission is to be received.

Because of the small aperture of such collectors, they are necessarily designed to have high gain, making precise alignment especially critical. For example, 18-inch diameter offset-fed parabolic reflectors are used in present commercial systems, having a 3 dB beam width of only approximately 2 degrees. Low cost precise alignment of such collectors in a consumer environment has been challenging. Accurate aiming of such satellite collectors is of significance especially in areas of the signal-receiving territory where rain fade is a problem. The more precise the aim of the satellite collector, the less serious is the rain fade problem, and the shorter its duration.

Existing satellite collector alignment equipment capable of precisely aligning such collectors is expensive and requires the services of a professional installer. Installation equipment which is capable of precisely aligning such satellite collectors, and yet which is affordable and readily useable by installers and even by the consumer is not available at present.

To align such a satellite collector for maximum receiver signal strength using today's methods, the satellite is pointed in the approximate direction of the satellite whose transmission is to be received. The collector is then adjusted in azimuth and elevation while the level of the received signal is monitored in search of a "peak". In practice, however, it has proven difficult to "peak" the received signal because the signal level meter comprising part of the satellite receiver typically has a non-linear response at the normal high "peak" signal levels. This non-linear response at the desired levels can mask the effect of small non-alignments, making them difficult for the user to notice. As a result, finding an exact orientation of the collector for peak signal reception is not readily achieved.

2. Description of Related Art

U.S. Pat. No. 4,888,596 discloses a method and apparatus for determining earth station parameters such as rain margin. The '596 technique utilizes a series of radiation attenuating pads which are manually held, or supported in a box-like holder, adjacent to a receiving horn. The pads attenuate radiation focused by a satellite dish on the horn. The attenuating pads are stacked one at a time in front of the horn while a service attendant watches a connected television receiver until "sparklies" appear on the television screen. The attenuation produced by the pads is logarithmically additive. When the sparklies are observed, the antenna orientation is then adjusted until the pattern of sparklies is minimized. The attenuation figure thus derived is used as a measure of the rain margin for the satellite communication system.

The approach of the '596 patent suffers from a number of drawbacks. First, it is cumbersome and slow in use, and not susceptible to being automated. With the method of the '596 patent, it would be difficult for an installer to determine signal peaking by observing the number or strength of the sparklies on the screen. It is not readily adaptable for use with digital transmissions (such as digital DBS transmissions), as images displayed of digitally transmitted signals do not degrade gradually or produce visible noise-like phenomena on a television screen which could be monitored to determine an acceptable minimum signal strength. Further, the attenuating pads must be maintained in sealed bags to prevent their degradation. Repeated use may therefore lead to damage and deterioration of the pads, reducing accuracy, convenience, and reliability. The adjustments in attenuation produced by the stacked pads are limited in resolution to a few discrete values, and continuous changes in the amount of attenuation of the incoming satellite signal are not possible. The '596 method thus suffers from lack of precision in determining the optimum satellite collector position.

SUMMARY OF THE INVENTION

The present invention provides a low cost, simple device with which satellite signal collectors, particularly small aperture consumer signal collectors, may be precisely aligned with a transmitting satellite. The device is employed to selectively attenuate satellite signals to a desired reduced level. In preferred embodiments, the output is reduced to levels which correspond to a more linear operating range for a standard low-cost signal strength meter. Alignment of the collector for maximum signal reception in this operating state of the receiver is thus simplified. In particularly preferred embodiments, the attenuation achievable is substantially continuous from a minimum to a maximum. Having achieved the desired precise aiming of the collector, the attenuating device may be removed or adjusted to permit the full incoming signal to be received.

The attenuating device is a radiation shield which may take a wide variety of forms. In a preferred embodiment, a pair of nested metal or metallized cups having overlapping signal-passing openings are provided. Rotation of one cup relative to the other causes a programmed change in the effective intersection area of the signal-passing openings in the cups, and therefore the degree of attenuation of the RF satellite signal received. In another execution of the invention, the radiation shield comprises a plurality of apertured shield members which are translated, rather than rotated, relative to each other to vary the effective radiation-passing area of the shield.

In a preferred execution of the invention, the shield members have overlapped slots or other opening patterns with pronounced directionality. The shield members may be rotated simultaneously such as to align their mutual slots to select a desired plane of polarization of plane-polarized radiation, and then may be rotated relative to each other to variably attenuate the selected plane-polarized radiation. In an environment of co-located or approximately co-located signals having, e.g., horizontal and vertical polarization, the present device is capable of effectively selecting RF energy of either polarization, and permitting alignment of the collector with respect to the selected one of the signals to the effective exclusion of the other.

A method according to the present invention for aligning a satellite RF radiation collector in a satellite receiving system comprises locating a variable RF radiation attenuator between the satellite and a low noise amplifier or other signal receiver. In particular embodiments, the attenuator is located between a collector and a low noise amplifier or other signal receiver. The attenuation of the signal is varied continuously until the signal level of the received radiation is within a desired range, such as at a point in the range of an associated signal level meter where the meter's response is more linear than it is at higher signal levels. The position of the collector relative to the satellite is then adjusted until the meter output peaks or otherwise exhibits a desired output characteristic. Finally, the attenuation produced by the attenuator is reduced or eliminated to permit normal operation of the satellite receiving system.

DESCRIPTION OF THE PREFERRED EMBODIMENT(S)

Figure 1:
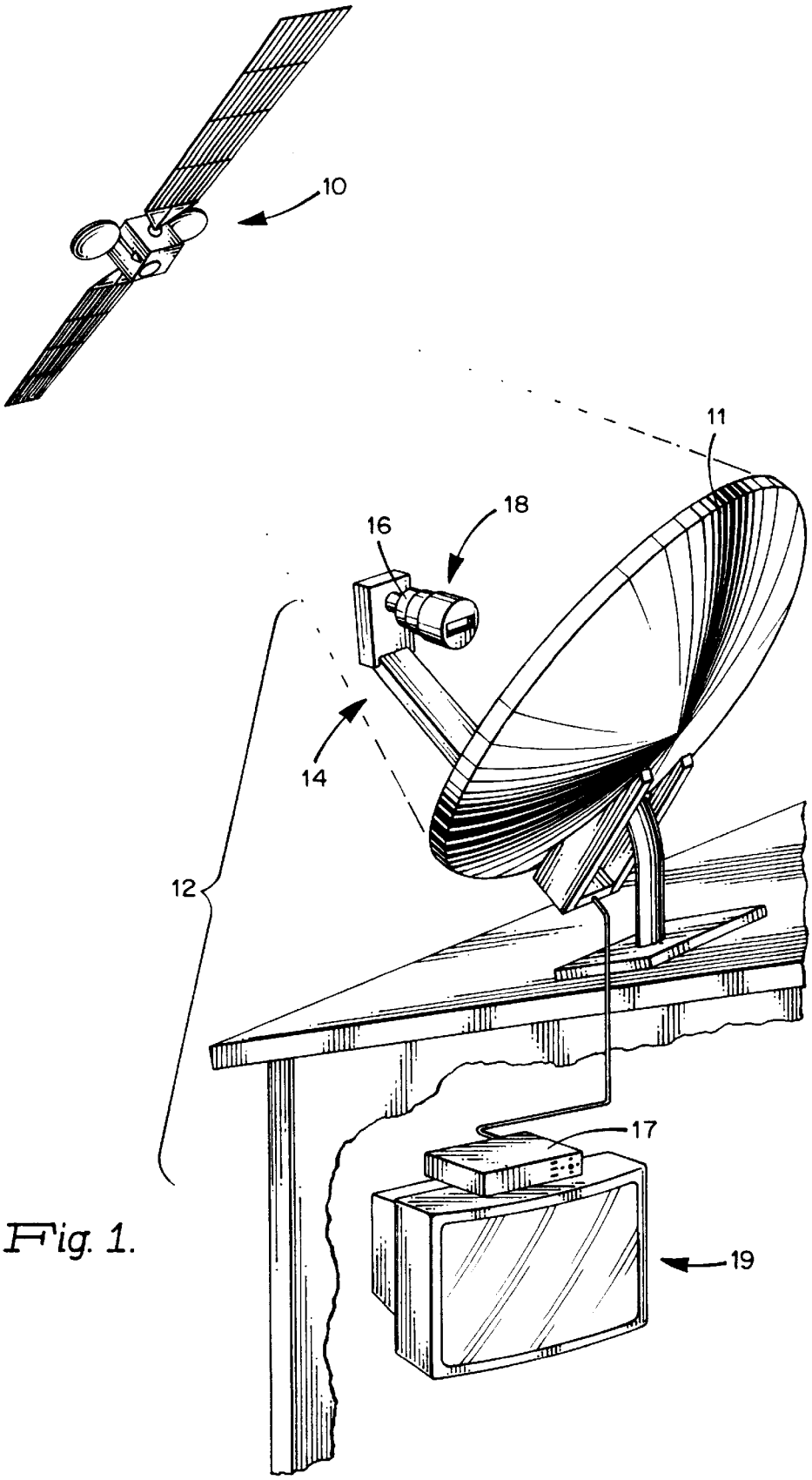
FIG. 1 is a view of a satellite communication system employing one embodiment of a signal attenuator according to the present invention.

The satellite communication system illustrated in FIG. 1 comprises a satellite 10 transmitting RF signals to a satellite receiving system 12 comprising a collector 11, a receiving horn 14 including a low noise block converter or "LNB" 16 wherein the received satellite signals are amplified and converted as a block to intermediate frequencies. The output of the LNB 16 is supplied to an integrated receiver-decoder or "IRD" 17 wherein the signals are further processed and supplied, for example, to a television receiver 19, or to a recorder, audio receiver, computer, or other device.

A variable signal attenuator 18 according to the present invention for selectively varying RF signals received from the satellite 10 is adapted to be mounted on the LNB 16. The mounting may be permanent or, in other embodiments, temporary (i.e. removable).

FIGS. 2–5 illustrate details of the variable signal attenuator 18. The signal attenuator 18 comprises a radiation shield having at least one selectively variable radiation-passing area. The shield comprises a pair of shield members 20, 22 having selectively overlapped openings 24, 26, respectively. In this embodiment, the openings 24, 26 take the form of elongated rectangular slots. The variable radiation passing area in this embodiment comprises the intersection of the respective slots 24, 26.

Figure 4:
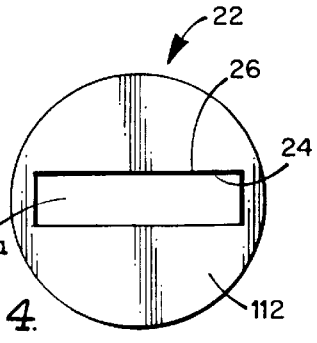
FIG. 4 illustrates the signal attenuator of FIGS. 1–3 as comprising in one embodiment two nested slotted radiation shields oriented with their slots aligned.
Figure 5:
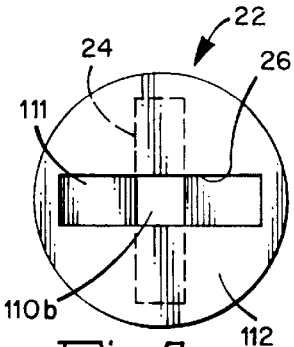
FIG. 5 is a view similar to FIG. 4 with the overlapped slots of the signal attenuator orthogonally oriented.

The shield members 20, 22 are moveable relative to one another to permit the effective radiation-passing area of the overall shield to be continuously varied. In the preferred FIGS. 1–5 embodiment, the shield members comprise nested cups. To continuously vary the effective radiation-passing area, the shield members are rotated one relative to the other from a position as shown in FIG. 4 wherein the openings 24, 26 are aligned, producing a maximum intersection 110*a* and thus a minimum attenuation, to an alternate position shown in FIG. 5 wherein the openings 24, 26 are orthogonally oriented and produce minimum intersection 110*b* and thus a maximum attenuation of the collected satellite signal.

In a particularly preferred embodiment, the openings 24, 26, and the maximum intersection (as shown at 110*a* in FIG. 4) are selected to pass the received signal with substantially no attenuation. The shield member preferably also permit the level of radiation attenuation to be varied continuously from this minimum (e.g., effectively zero) attenuation to a maximum level of attenuation (e.g., to a level wherein the received signal strength is suppressed to a desired level below an acceptable maximum.) In the embodiment shown, for example, shield member 22 may be rotated continuously relative to member 20, resulting in continuously varying intersection area 110. It will be understood that friction or other means, such as detents, may be provided to stabilize the shields in a desired position.

The shield members 20, 22 may be composed of any radiation shielding material. For example, they may be composed of metallized plastic, or may consist of a conductive metal cup. The shield members 20, 22 are preferably formed of molded plastic having a metallization on the inner and/or outer surfaces. The outer shield member 22 is illustrated as being composed of a plastic body 22*a* having an outer metallization layer 23; see FIG. 2A. The inner shield member 20 may comprise a plastic body 20*a* having a metallization layer 25 on its inner surface. It should be understood that alternative orientations of the respective layers are also possible. Alternatively, the shields may be composed of a plastic material in which is embedded electrically conductive particles.

In the embodiment of FIGS. 2–5 the shield members 20, 22 include, respectively, end portions 111, 112 and body portions 113, 114. Openings 24, 26 are located in the respective end portions 111, 112. These end portions are supported, respectively, by body portions 113, 114. The body portions are preferably adapted to support the end portions in a desired functional relationship (e.g., close parallel proximity at a desired orientation). It should be understood, however, that alternative techniques may be utilized for physically mounting or connecting one or both of the end portions 111, 112 to provide the desired functional orientation. By way of example only, the body portion of one or both shield members may be reduced or eliminated. In a particular alternative, body member 114 could be substantially or completely eliminated, and a substantially planar end portion 112 could be rotatably supported proximate end portion 111, either in front of or behind end portion 111 relative to the LNB 16.

Preferably one or both of the body portions provide additional shielding to the receiving element of the LNB 16, including shielding of off-axis signals. For example, as shown in FIG. 2, the body portion 113 may enclose or otherwise functionally shade the operative portions of LNB 16 from RF signals in the relevant frequency spectrum.

In one embodiment, body portion 113 may comprise an inner cavity which is configured to cooperate with the outer surface of at least a portion of a typical LNB housing, as shown. In a particular embodiment, the inner configuration may comprise a truncated conical surface dimensioned to receive and cooperate with the outer surface of a cylindrical or truncated conical LNB housing. In a further embodiment, both shield members may comprise body elements having cooperating truncated conical forms, such that a first shield member includes a body member with an inner surface or cavity adapted to cooperate with an LNB housing and an outer surface comprising a truncated conical surface, and a second shield member includes an inner truncated conical surface corresponding to the outer surface of the first shield member. In this manner, the two shield members can nest in a secure relationship. In yet another embodiment, the shield members may be structurally identical, thereby reducing manufacturing costs.

Although the embodiments of FIGS. 1–5 illustrate two shield members in selectable juxtaposition, it should be understood that a greater number of shield numbers may alternatively be used in other embodiments. For example, three shield members could be nested or otherwise supported in functional relationship as previously described.

Figure 2:
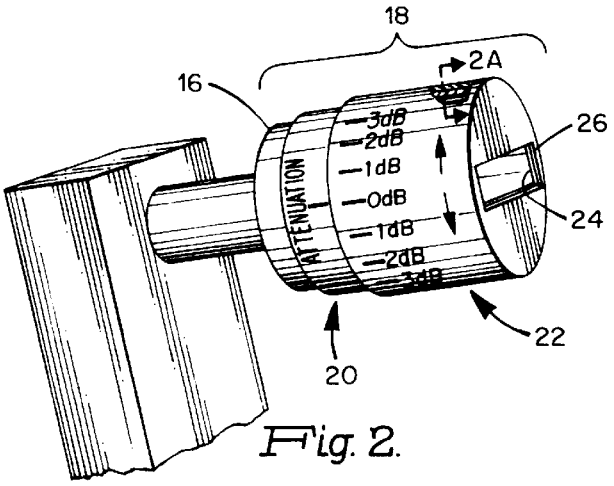
FIG. 2 is an enlarged fragmentary side elevation view of the signal attenuator in FIG. 1.
Figure 2A:
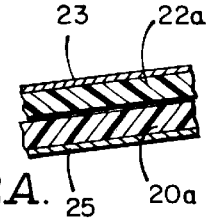
FIG. 2A is an enlarged view of a fragment of FIG. 2.
Figure 3:
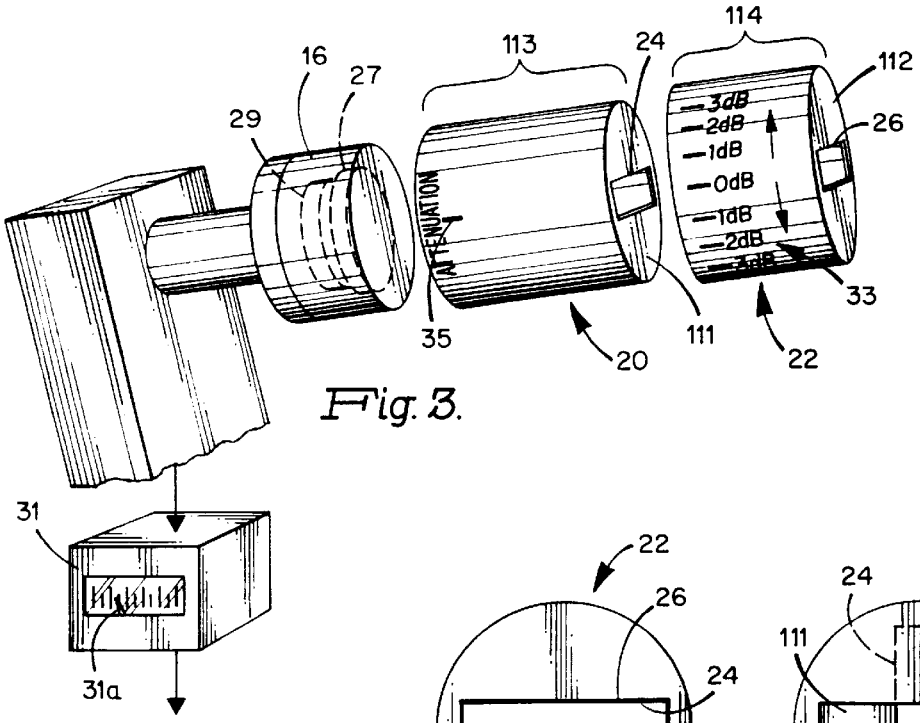
FIG. 3 is an exploded perspective view of the signal attenuator illustrated in FIGS. 1 and 2.
Figure 6:
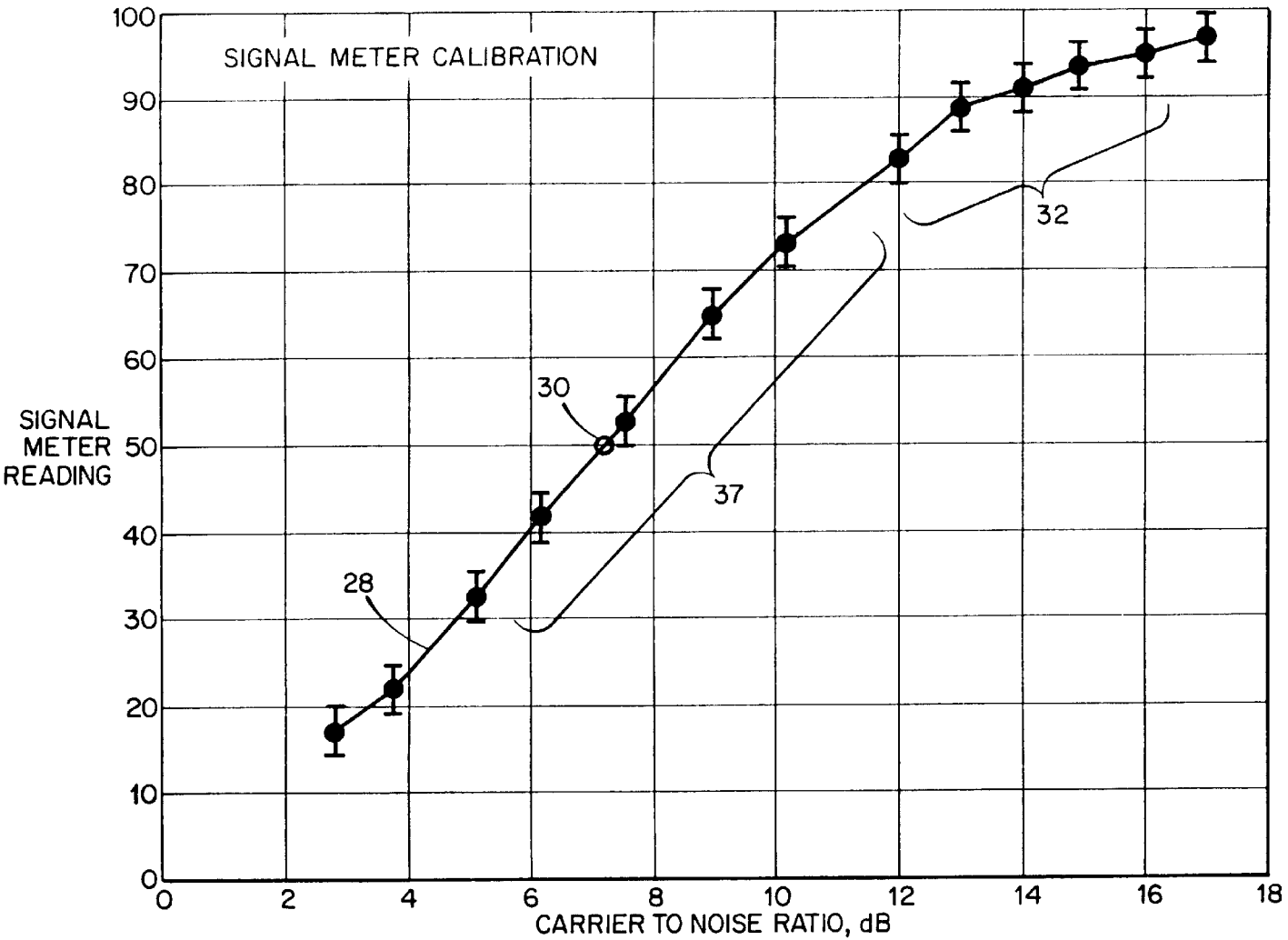
FIG. 6 depicts a characteristic of a typical satellite receiver signal meter, illustrating how signal level varies with carrier signal-to-noise ratio.

The LNB 16 includes a low noise amplifier 27 and a block converter 29, both shown in phantom lines in FIG. 2. The output of the block converter 29 is supplied to an indicator, here shown schematically at 31 as a signal meter 31 having a display 31*a*. The meter 31 may comprise meter circuitry incorporated in the IRD 17 having its output displayed on the screen of the associated television receiver 19, or other known display or output devices, visual or aural. The meter output is related to received relative signal level. FIG. 6 is a signal meter characteristic 28 showing how carrier signal-to-noise ratio in decibels may vary with received relative signal level.

In accordance with a method of the present invention for aligning a satellite RF signal collector in a satellite receiving system having a signal level meter and a low noise amplifier, a variable RF radiation attenuator such as shown at 18 is located between the satellite 10 and the LNB 16. In particular embodiments, the variable RF attenuator is located between a collector and the LNB 16. By means of the variable attenuator 18, the signal level received is selectively attenuated until the signal level of the received radiation falls within a range of signal strengths for which the response of the signal meter is more linear than it is at higher signal levels. The position of the collector is then adjusted until the meter output peaks, indicating maximum received signal strength for the setting of the signal attenuator 18. The signal attenuator 18 may then be removed or set to a negligible attenuation level to permit normal operation of the satellite receiving system.

In FIG. 6, it is seen that the signal meter characteristic 28 is quite linear in a mid-range 37 between relative signal levels of 30 and 70. In accordance with the present invention, the attenuator 18 is preferably adjusted until the signal meter reading is at a point in a mid-range operating point 30 of characteristic 28, shown by way of example at level 50. By selecting a level of attenuation produced by the attenuator 18 such as to establish an operating point in a range of the characteristic 28 which is more linear than at higher signal levels, sufficient room is left above and below the operating point 30 to allow for wide variances in signal level as the collector orientation is adjusted to seek the peak signal level.

In a more general sense, in accordance with the aforedescribed method the position of the collector is adjusted until the meter output exhibits a desired characteristic. In an application wherein it is desired to aim the collector at a point in the sky between two co-located satellites whose signals are received, the desired meter output characteristic may be a minimum, rather than a maximum.

One or more of the radiation shield members of the present invention may be marked with indicia 33 indicating the level of attenuation produced by the shield members for any given relative setting of the shield members. For example, as shown in FIG. 2, the outer shield member 22 may be marked to show gradations of attenuation in decibels. Alignment of the indicia 33 on the outer shield member 22 with a fiducial mark 35 on the inner shield member 20 tells the user the degree of attenuation of the received satellite signal that will be produced by the signal attenuator at the indicated setting of the shield members 20, 22. If additional shield members are optionally provided they may also bear appropriate indicia.

Figure 7:
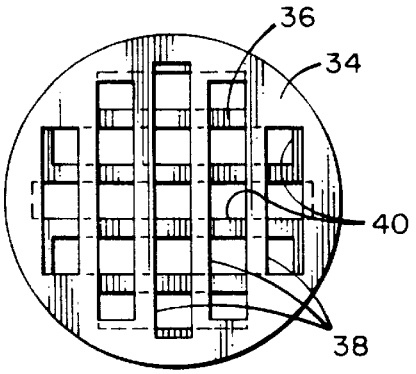
FIGS. 7–12 illustrate alternative implementations of shield members which may be employed in alternative embodiments of the present invention.

FIGS. 7–11 illustrate additional alternative shield structures. In FIG. 7, the shield members 34, 36 have a plurality of slots 38, 40, respectively. In the FIG. 7 embodiment, the shield members 34, 36 are rotated relative to each other between a position as shown wherein the maximum radiation attenuation is achieved, to a position (not shown) wherein the slots 38, 40 are aligned and a minimum radiation attenuation is produced.

Figure 8:
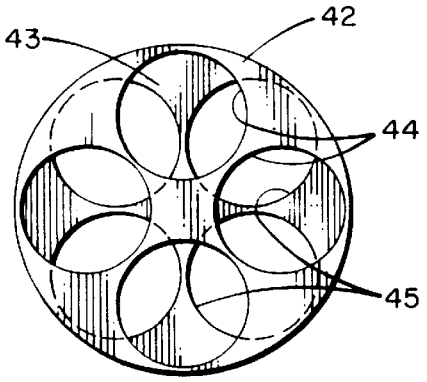

FIG. 8 illustrates an alternative embodiment wherein the shield members 42, 43 each have a plurality of like patterns of circular apertures 44, 45. The shield members 42, 43 may be rotated one relative to the other to vary the degree of attenuation of the transmitted radiation. FIG. 8 shows the apertures 44, 45 in the two shield members 42, 43 as being aligned for maximum signal attenuation.

Figure 9:
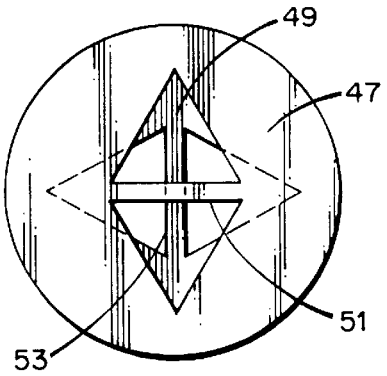
Figure 10:
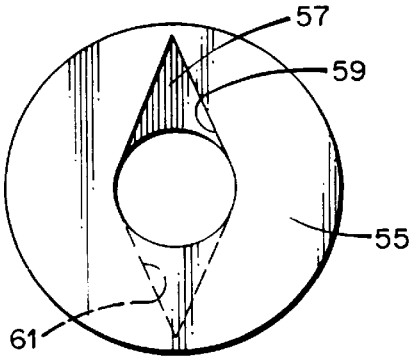

In the FIG. 9 embodiment, relatively rotatable shield members 47, 49 with paired triangular openings 51, 53 are set in a maximum attenuation position. In FIG. 10, shield members 55, 57 have tear-shaped apertures 59, 61.

Figure 11:
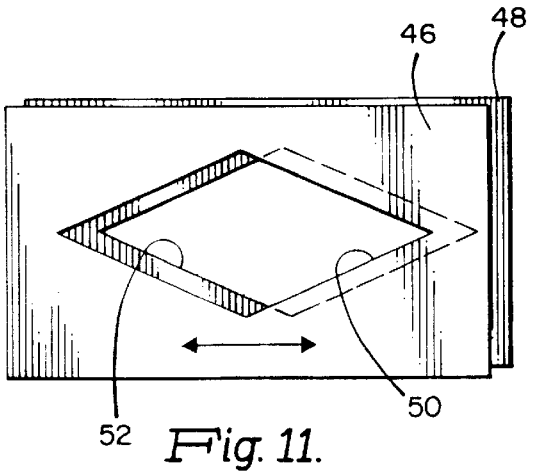
Figure 12:
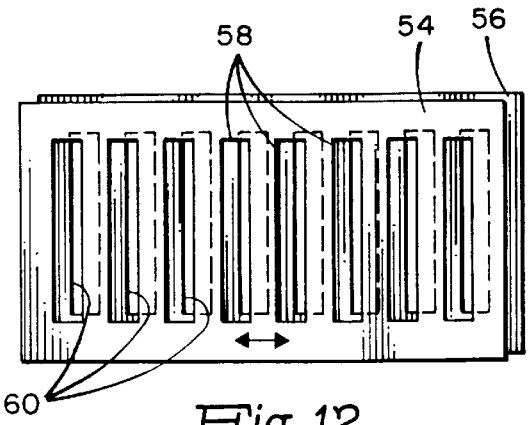

FIG. 11 illustrates a pair of shield members 46, 48 which are translated rather than rotated, having apertures 50, 52 which are diamond shaped. FIG. 12 shows translatable shield members 54, 56 having patterns of slots 58, 60. The members are positioned one relative to the other such as to produce a mid-range attenuation level.

It will be evident from the preceding description that the invention encompasses a great variety of possible implementations, the relative movement of the shield members being variable, as is the configuration of the radiation-passing openings, to achieve a desired program of gradation of the level of attenuation as one shield member is moved relative to another. As shown, the radiation-passing apertures may take any of a variety of configurations depending upon the manner in which it is desired to have the radiation attenuation vary with relative movement of the shield members.

Figure 13:
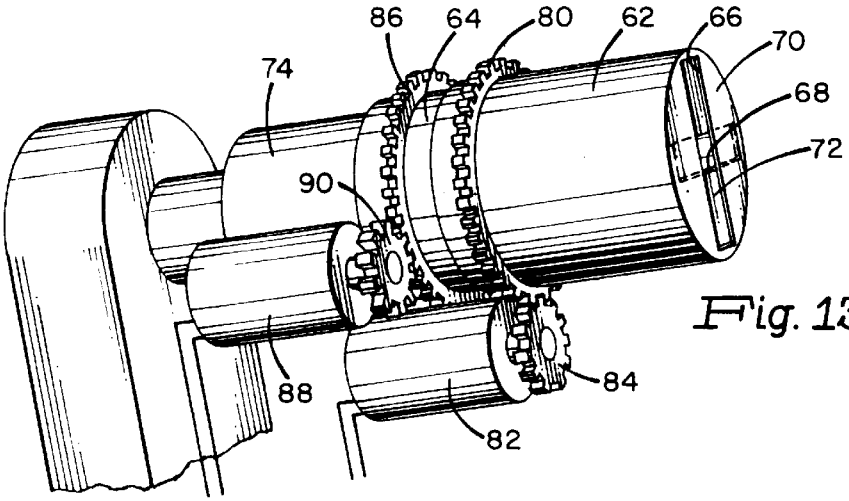
FIG. 13 is a schematic illustration of a motorized version of the embodiment shown in FIGS. 1–5.

FIG. 13 illustrates a motorized version of the FIGS. 1–5 embodiment. In FIG. 13, shield cups 62, 64 have rectangular slots 66, 68 in their respective end faces 70, 72. The cups 62, 64 are nested one with respect to the other, and with respect to an LNB 74.

The shield cups 62, 64, like the FIGS. 1–5 shield members 20, 22, are preferably composed of metallized molded plastic. The outer shield member 62 has formed integrally therewith a ring gear 80 which is driven by a motor 82 through a spur gear mating with the ring gear 80. If desired, and as illustrated, both shields may be automated. For example, the inner shield cup 64 may similarly have a ring gear 86 molded integrally therewith to be driven by a motor 88 through a spur gear 90. Alternatively, one shield may be stationary with respect to the LNB, and the other automated. The shield cups 62, 64 may be driven by signals transmitted remotely from the IRD, or otherwise activated.

In professional satellite receiving systems such as might be found at a cable head end, wherein alignment of the collector is motorized, a motorized signal attenuating system implementing the invention may be incorporated into the collector alignment system to improve the convenience and accuracy of collector alignment.

It should be understood that the FIG. 13 embodiment is schematic and illustrative only, and that various other ways exist within the skill of the art to motorize or completely automate the adjustment of the level of attenuation produced by the signal attenuator of the present invention. Motive means other than motors may be used, or a single motive means (e.g. motor) may be configured by suitable linkage to move both shield members.

In accordance with the teachings of the present invention, in an embodiment such as shown in FIGS. 1–5 or FIG. 13 wherein the apertures have a strong directionality, and wherein the received radiation is plane-polarized, the slot openings 24, 26 may be first aligned with respect to each other for minimum attenuation, and then rotated together with their openings 24, 26 aligned to determine the plane of polarization of the received plane-polarized radiation. Having aligned the openings 24, 26 with the selected plane of polarization, the radiation shield members 20, 22 may be rotated one relative to the other to attenuate the incoming radiation until the received signal strength lies in a more linear range of the associated signal meter, as described above.

Using this technique, in an environment wherein signals having horizontal and vertical planes of polarization are being received from two co-located satellites, or are being received from a single satellite transmitting both horizontal and vertically polarized signals, by rotating the shield members 20, 22 with their openings aligned, one signal may be selected, and the other signal rejected. Having selected one of the two signals by coinciding the plane of least attenuation of the openings with the polarization plane of the desired plane polarized signal, the collector may be then aimed precisely at the source of those signals using the method of the present invention.

If the other signal, that is, the signal having a plane of polarization orthogonal to the plane of polarization of the aforesaid first signal, is being transmitted by a different satellite, the collector may then be aligned with that satellite following the same procedure.

Figure 14:
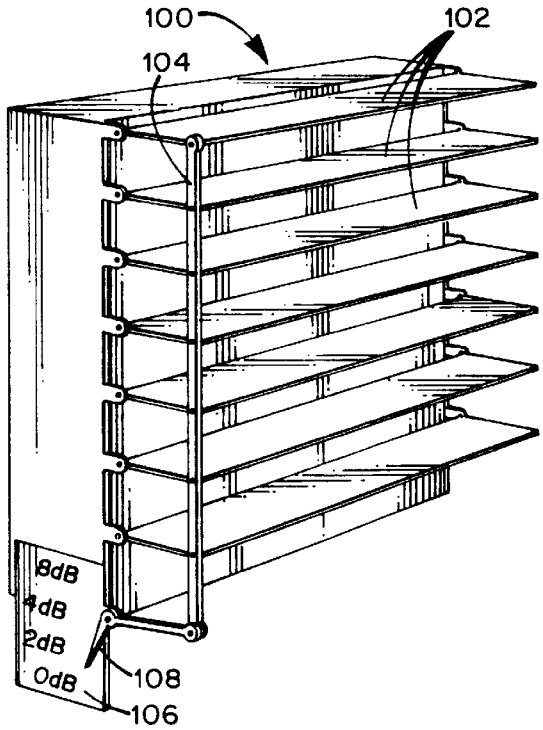
FIG. 14 illustrates one embodiment of the invention applied to a flat plate antenna.

FIG. 14 illustrates in highly schematic fashion the principles of the present invention implemented in a flat plate antenna 100. In this embodiment, the attenuator is between the satellite and the receiving elements of the antenna 100, proximate to the antenna. The signal attenuator is illustrated as comprising a plurality of parallel slats 102 which are pivoted along their longitudinal axes such that they may be conjointly rotated from a full open position to a full closed position to vary the satellite signal attenuation from substantially zero to substantially 100 percent.

In the schematically illustrated FIG. 14 embodiment, the slats 102 are each pivoted along an edge adjacent to the antenna 100 and are moved in synchronism by an actuator bar 104 pivotally coupled to the opposed edges of the slats 102. Alternatively, the slats 102 may be pivoted at their central lines and may be moved in synchronism by actuating structures other than as shown. It is within the scope of the present invention to motorize the opening and closing of the slats 102.

As in the FIGS. 1–5 embodiment, the FIG. 14 embodiment may be provided with indicia 106 indicating the degree of attenuation produced by the slats 102 at any particular setting of the slats 102. A needle indicator 108 coupled to the actuator bar 104 cooperates with the indicia 106 to give the user the indicated attenuation information.

Figure 15:
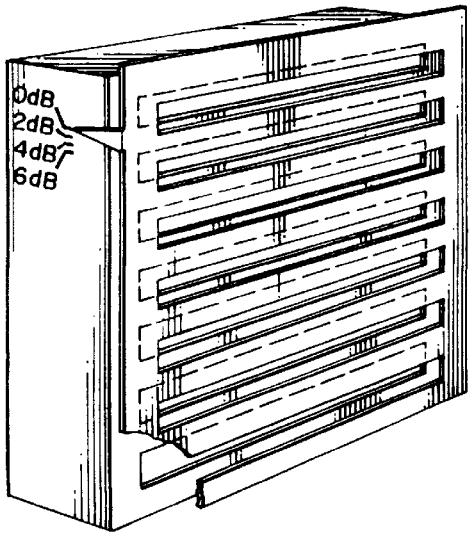
FIG. 15 illustrates an alternative embodiment of the invention applied to a flat plate antenna.

FIG. 15 illustrates an alternative to the FIG. 14 attenuator structure, including a reciprocable shutter arrangement (such as shown in FIG. 12) adapted for use with a flat-plate-type antenna.

Numerous other variations of the foregoing invention are also possible. It should be understood, therefore, that a wide range of other changes and modifications can be made to the preferred embodiment and the alternative embodiments described above. It is therefore intended that the foregoing detailed description be regarded as illustrative rather than limiting, and that it be understood that it is the following claims, including all equivalents, which are intended to define the scope of the invention.

What is claimed is:

1. For use with a satellite receiving system having a receiving element, a selectively variable RF signal attenuator locatable between a satellite and a receiving element comprising an RF radiation shield having at least one selectively continuously variable radiation-passing area.

2. The signal attenuator defined by claim 1 wherein the radiation shield comprises a plurality of overlapped shield members having selectively overlapped openings, movement of one member relative to the other causing the effective intersection of said overlapped openings to vary, said radiation-passing area of said shield comprising said intersection.

3. The signal attenuator defined by claim 2 wherein at least one of said shield members is rotatable relative to at least one other shield member.

4. The signal attenuator defined by claim 3 further comprising a motive element functionally coupled to at least one of said shield members.

5. The signal attenuator defined by claim 3 wherein the shield members comprise at least one cup member which surrounds the input to a low noise amplifier when mounted for use and which cooperates with a second shield member, the cup member and the shield member having overlapped apertures such that rotation of at least one of said members relative to the other members varies the effective size of the radiation-passing area in the radiation shield.

6. The signal attenuator defined by claim 5 wherein said cup member and said second shield member are constructed and arranged as nested truncated comes with mating end walls defining said overlapped openings.

7. The signal attenuator defined by claim 6 wherein said apertures comprise slots.

8. The signal attenuator defined by claim 5 wherein said apertures are circular and not coaxial with the axis of relative rotation of said shield members.

9. The signal attenuator defined by claim 3 wherein said intersection of said overlapped openings in the shield members is configured, when said shield members have a predetermined rotational orientation relative to each other and to incident radiation, to predominantly pass incident radiation of a selected polarization.

10. A satellite receiving system comprising:

a radiated RF signal collector;

a low noise amplifier; and a selectively variable RF signal attenuator located in the path of a received satellite signal, comprising a radiation shield having at least one selectively variable non-attenuating radiation-passing area.

11. The system defined by claim 10 wherein the radiation shield comprises a plurality of overlapped shield members having selectively overlapped openings, movement of one member relative to the other causing the effective intersection of said overlapped openings to vary, said non-attenuating radiation-passing area of said shield comprising said intersection.

12. The system defined by claim 11 further comprising a motive element functionally coupled to at least one of said plurality of overlapped shield members.

13. The system defined by claim 11 wherein at least one of said shield member is rotatable relative to at least one other of said shield members.

14. The system defined by claim 13 wherein the shield members comprise at least one cup member which surrounds the input to the low noise amplifier when mounted for use and which cooperates with a second shield member, the cup member and the shield member having overlapped apertures such that rotation of at least one of said members relative to the other members varies the effective size of the non-attenuating radiation-passing area in the radiation shield.

15. The system defined by claim 14 wherein said apertures comprise slots.

16. The system defined by claim 14 wherein said intersection of said overlapped openings in the shield members is configured, when said shield members have a predetermined rotational orientation relative to each other and to incident radiation, to predominantly pass incident radiation of a selected polarization.

17. A method useful in the alignment of a satellite signal collector in a satellite receiving system having a signal level indicator, said method comprising:

locating a continuously variable RF signal attenuator in the path of a satellite signal;

adjusting said continuously variable attenuator to vary the attenuation of the received signal through a continuum of attenuation levels until the signal level of the attenuated signal corresponds to a desired operating range of the signal level indicator; and adjusting the position of the collector until the indicator exhibits a desired output characteristic.

18. The method defined by claim 17 wherein said continuously variable attenuator comprises a radiation shield having at least one selectively continuously variable radiation-passing area.

19. The method defined by claim 18 wherein the radiation shield comprises a plurality of overlapped shield members having selectively overlapped openings, and wherein said method includes moving one shield member relative to the other member to cause the effective intersection of said overlapped openings to vary, said radiation-passing area of said shield comprising said intersection.

20. A method useful in the alignment of a satellite signal collector in a satellite receiving system having a signal level indicator, said method comprising:

locating a continuously variable RF signal attenuator in the path of a satellite signal;

adjusting said continuously variable attenuator to vary the attenuation of the received signal until the signal level of the attenuated signal corresponds to an operating range of the signal level indicator wherein the indicator response is more linear than it is at higher signal levels;

adjusting the position of the collector until the indicator exhibits a desired output characteristic; and reducing the attenuation produced by the attenuator to permit normal operation of the satellite receiving system.

21. The method defined by claim 20 wherein said continuously variable attenuator comprises a radiation shield having at least one selectively variable radiation-passing area.

22. The method defined by claim 21 wherein the radiation shield comprises a plurality of overlapped shield members having selectively overlapped openings, and wherein said method includes moving one shield member relative to the other member to cause the effective intersection of said overlapped openings to vary, said radiation-passing area of said shield comprising said intersection.

23. The method defined by claim 22 wherein at least one of said shield members is rotatable relative to at least one other shield member, and wherein said method includes rotating one shield member relative to the other member.

24. The method defined by claim 23 wherein said system includes a low noise block converter, and wherein the shield members comprise nested cups which surround the low noise block converter when the cups are mounted for use, and wherein the cups have overlapped apertures in their end walls such that rotation of one cup relative to the other varies the effective size of the radiation-passing area in the radiation shield.

25. The method defined by claim 24 wherein said apertures comprise slots.

26. The method defined by claim 23 wherein said intersection of said overlapped openings in the shield members is configured, when said shield members have a predetermined rotational orientation relative to each other and to incident radiation, to predominantly pass incident radiation of a selected polarization, and wherein said method comprises rotating said shield members together to pass predominantly radiation having said selected polarization, and then rotating one shield member relative to the other shield to variably attenuate the selected radiation.

* * * * *